United States Patent [19]

Dennis et al.

[11] Patent Number: 4,760,707

[45] Date of Patent: Aug. 2, 1988

[54] THERMO-CHARGER FOR MULTIPLEX AIR CONDITIONING SYSTEM

[75] Inventors: Richard D. Dennis, Bridgeport; John D. Manning, Liverpool, both of N.Y.

[73] Assignee: Carrier Corporation, Syracuse, N.Y.

[21] Appl. No.: 57,673

[22] Filed: Jun. 3, 1987

Related U.S. Application Data

[63] Continuation of Ser. No. 780,466, Sep. 26, 1985, abandoned.

[51] Int. Cl.[4] ..... F25B 5/00

[52] U.S. Cl. ..... 62/197; 62/199; 62/513

[58] Field of Search ..... 62/197, 199, 200, 113, 62/117, 513

[56] References Cited

U.S. PATENT DOCUMENTS

| | | | |
|---|---|---|---|
| 2,047,827 | 7/1936 | Lamb | 62/117 X |
| 2,388,556 | 11/1945 | Lathrop | 62/200 X |
| 3,150,498 | 9/1964 | Blake | 62/113 X |
| 3,390,540 | 7/1968 | Brush | 62/200 |
| 4,316,366 | 2/1982 | Manning | 62/200 |

FOREIGN PATENT DOCUMENTS

| | | | |
|---|---|---|---|
| 0129546 | 10/1979 | Japan | 62/197 |

*Primary Examiner*—Harry B. Tanner

*Attorney, Agent, or Firm*—Dana F. Bigelow

[57] ABSTRACT

A subcooler is provided in heat exchange relationship with the high pressure liquid refrigerant line flowing to the indoor coil, such that when a low pressure condition is sensed on the low pressure side of the system, the subcooler flashes a portion of the liquid refrigerant to the low pressure side to thereby maintain suction pressure to the compressor, while at the same time subcooling the liquid refrigerant flowing to the fan coil to thereby increase its efficiency.

7 Claims, 2 Drawing Sheets

THERMO-CHARGER FOR MULTIPLEX AIR CONDITIONING SYSTEM

This application is a continuation of application Ser. No. 780,466 filed Sept. 26, 1985 now abandoned.

BACKGROUND OF THE INVENTION

This invention relates generally to air conditioning systems and, more particularly, to the application of a thermo-charger apparatus to a multiple fan coil air conditioning system.

The use of multiple indoor coils in combination with a single outdoor coil in a so-called multiplex system is becoming more popular where it is desirable to control the environment in individual rooms such as in residential and light commercial applications. It is common in such systems to have only a portion of the fan coils in active operation at any particular time. When this occurs, the smaller active indoor coil(s) tends to be overpowered by the relatively larger outdoor coil which is necessarily large enough for use with the entire indoor coil array. For example, in a typical unit with three indoor coils, there will often be times when only one of those coils is in active operation. If the system is being used in the heating mode, there will be insufficient condensing surface to maintain a balanced condition. As a result, the compressor discharge pressure will tend to increase until it reaches a predetermined threshold point, at which time a safety switch will turn the system off.

If the single indoor coil is being used in the cooling mode, the unbalanced condition will tend to increase the level of superheating in the evaporator coil. This, in turn, will tend to decrease, and eventually cause the loss of, suction to the compressor. In addition, the operation at such higher superheat conditions will be less efficient.

One approach to solving the problem of system imbalance as described hereinabove is that of providing a bleed-off valve between the high and low pressure sides of the system. The temperature at the low pressure side is sensed, and when it reaches a predetermined threshold level, the bleed-off valve is opened to allow a portion of the liquid refrigerant to flash over to the low pressure side where it returns to the compressor without first passing through the indoor coil. In this way, system balance may be maintained. However, it will be recognized that in such a system, the single active indoor coil does not operate as efficiently as it would otherwise operate under normally balanced conditions.

It is therefore an object of the present invention to provide for a multiplex air conditioning system with improved operational characteristics.

Another object of the present invention is the provision in a multiplex air conditioning system for maintaining a thermodynamically balanced system during periods when only a portion of the fan coil array is in active operation.

Yet another object of the present invention is the provision in a multiplex air conditioning system for improved efficiencies when operating with only a portion of the indoor coils in active operation.

Yet another object of the present invention is the provision for a multiplex air conditioning system which is economical to manufacture and useful in operation.

These objects and other features and advantages become more readily apparent upon reference to the following description when taken in conjunction with the appended drawings.

SUMMARY OF THE INVENTION

Briefly, in accordance with one aspect of the invention, there is placed in the refrigerant circuit between the outdoor coil and the indoor coil(s), a flash subcooler which, in response to a sensed high superheat condition on the low pressure side of the system, opens a valve to bleed back a portion of the high pressure liquid refrigerant to the low pressure side of the system. In this way, the suction at the low pressure side of the compressor is maintained.

By another aspect of the invention, the flash subcooler uses the energy of the refrigerant, as it flashes off to return to the low pressure side, for cooling the liquid refrigerant line which is placed in heat exchange relationship therewith. In this way, the liquid refrigerant flowing to the evaporator is sub-cooled to thereby increase the volume flow to the evaporator and thereby increase its operating efficiency.

In the drawings as hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
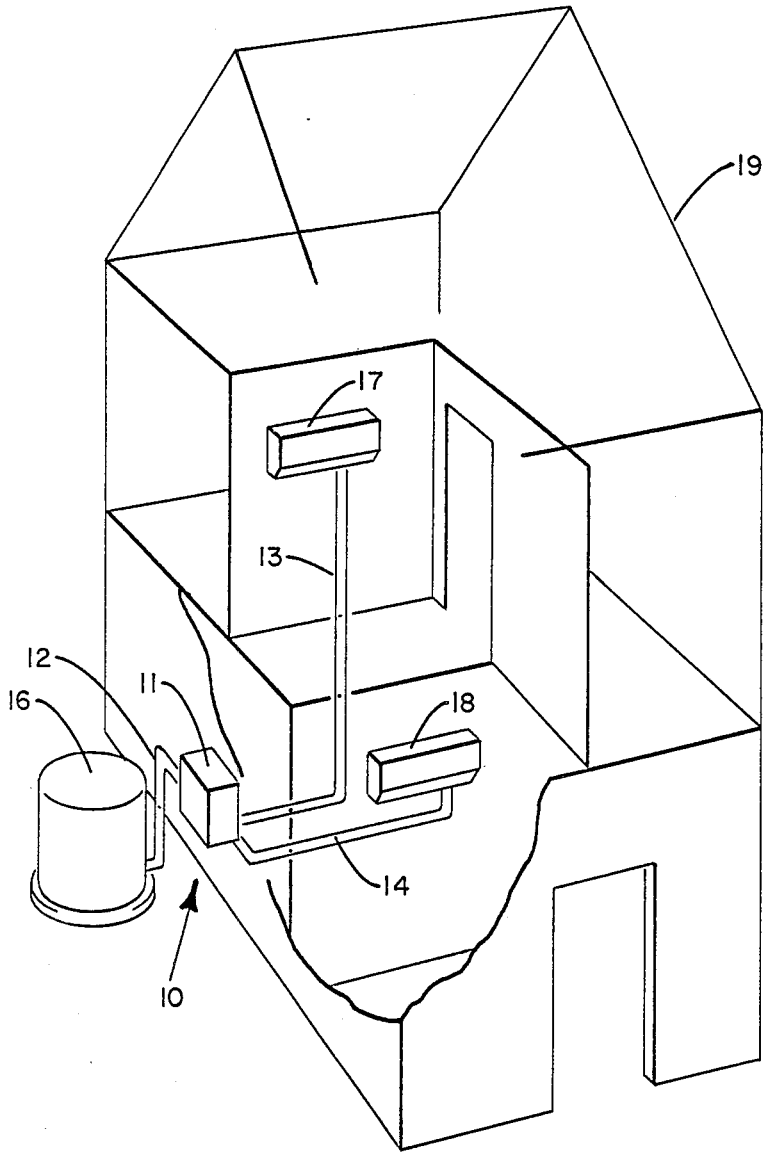
FIG. 1 is a perspective view of an installed multizone heat pump system with the present invention incorporated therein.

Referring now to FIG. 1, the invention is shown generally at 10 as incorporated in a control box 11 which is fluidly and electrically interconnected, by lines shown generally at 12, 13 and 14, between an air conditioning outdoor section 16 and the indoor fan coils 17 and 18. The system is installed in a building 19 where it is desired to have independent control and operation of the individual heating and air conditioning units within the various rooms of the building 19. For example, in the installation as shown, each of the individual fan coils 17 and 18 have their own thermostats (not shown) located in their respective rooms, and the associated fan coils 17 and 18 are responsively operated, independent from each other, to provide heating or cooling to their respective rooms as required to meet the demands indicated by their respective thermostats. Thus, it may be that both of the fan coils 17 and 18 are operating simultaneously in either the cooling or heating mode, or that, while one of the fan coils 17 or 18 is operating in the cooling or heating mode, the other fan coil is turned off.

Aside from the manner of operation as described hereinabove, the fan coils 17 and 18 are of a rather conventional design and include: a refrigerant-to-air heat exchanger coil; a fan to circulate air from the room, across the heat exchanger coil, and back into the room; and a motor to drive the fan.

As will be seen in FIG. 1, the fan coil 17 is located at a higher elevation than the fan coil 18. Such an arrangement is common and desirable in multizone heat pump systems, but is the cause of differential refrigerant flow problems as discussed hereinabove. It is thus one of the design features included in the control box 11 to alleviate the problems associated with the differential elevations.

Another problem addressed by the apparatus within the control box 11 is that of differential fan coil capacities as discussed hereinabove. This occurs, for example, when the fan coil 17 and 18 are placed in different sized rooms or the primary use of the rooms is substantially different. For example, the heating/cooling requirements would be substantially different in (a) a room containing electronic devices such as computers or the like, (b) a kitchen with large ovens, and (c) a family room which is partially below ground level. It is thus desirable to match the size of the individual fan coils with the projected heating/cooling requirements of their particular rooms. The associated problems as discussed hereinabove must then also be addressed.

The outdoor section 16 is of a conventional design and includes a compressor, a heat exchange coil, a fan and drive motor. It will be recognized that the components of the outdoor section 16 must be sized for proper operation with all of the fan coils operating simultaneously, while at the same time being capable of operating with less than all of the fan coils in operation. For example, in a three fan coil system it may be quite common to operate with only one of those fan coils on while the others are effectively removed from the system.

Control for the multizone system is primarily provided by the control box 11 which is shown in FIG. 1 as being installed on the outer side of the building 19, near the outdoor section 16. It should be recognized, however, that this unit and/or the components contained therein may just as well be located within the outdoor section 16 or within the building 19, such as in the garage, a control room, or even between the outer and inner walls of the building.

Figure 2:
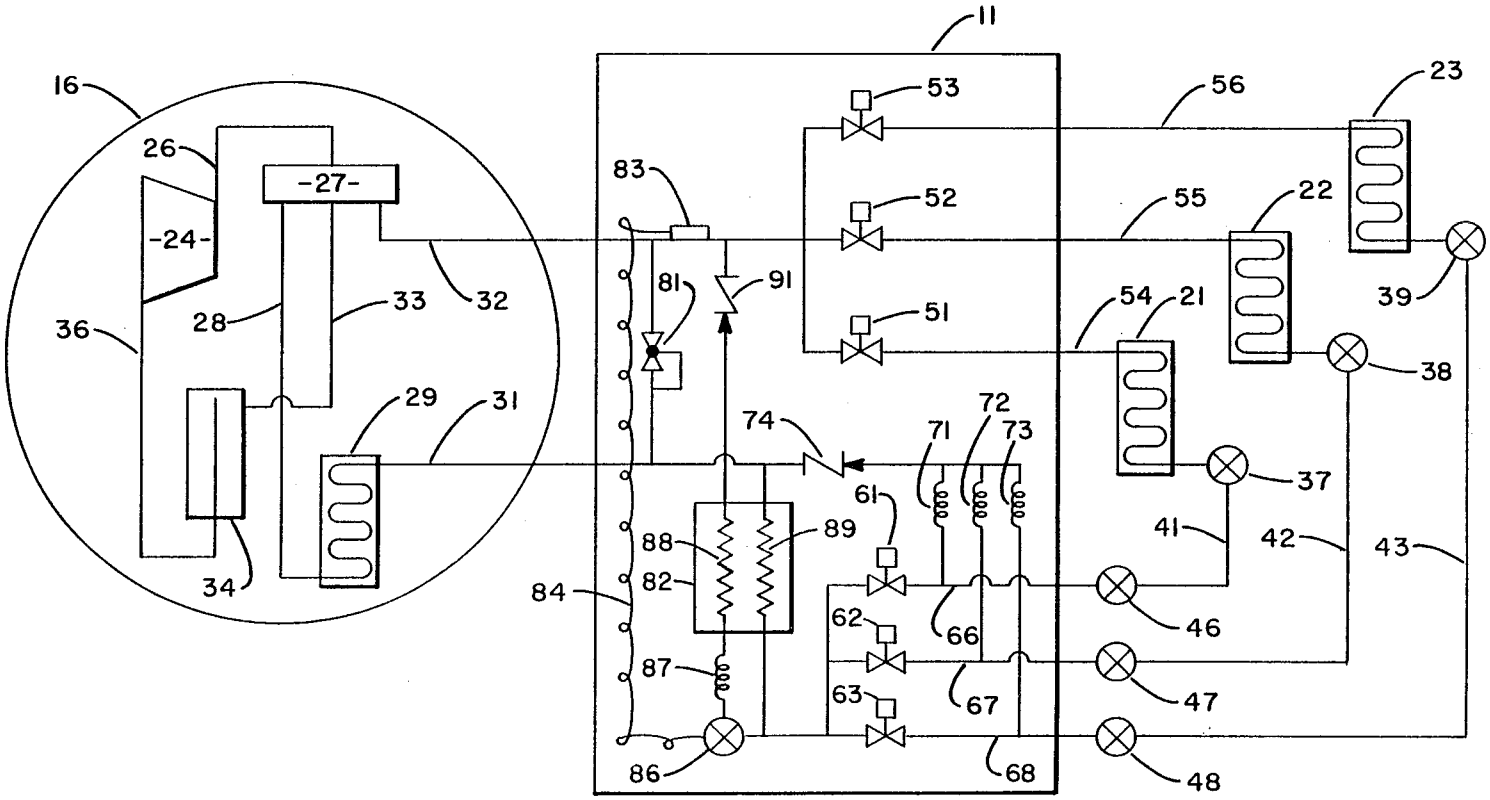
FIG. 2 is a schematic illustration of a multizone heat pump system with a preferred embodiment of the present invention incorporated therein.

Referring now to FIG. 2, there is shown a schematic illustration of the refrigerant flow apparatus and included components of the outdoor section 16, the control box 11, and the indoor fan coil units. While there are three such fan coils 21, 22 and 23 shown as equivalents, in design, purpose, and function, as the fan coils 17 and 18 described hereinabove, there may be more or less such fan coils in any particular installation. Further, although the fan coils 21, 22 and 23 are not pictorially distinguished in relative size or elevation, it should be understood that various sizing and elevational requirements may be imposed on the fan coil array to meet the various installation requirements. The control box 11 and the various components therewithin are designed to accommodate these requirements for variation.

Referring first to the outdoor section 16, the compressor is shown at 24 with its discharge line 26 connected to a four-way valve 27, which is operable in a conventional manner to selectively direct the flow of refrigerant to the outdoor coil or to one or more of the indoor coils to effect the cooling or heating cycle, respectively. Thus, during the cooling cycle the four-way valve 27 directs the flow of refrigerant along line 28 to the outdoor coil 29 where it is condensed, with its liquid passing along line 31, to the control box 11 where it is controlled in a manner to be described hereinafter. Liquid refrigerant is then expanded, passed through one or more of the indoor coils 21, 22 or 23, passed back through the control box 11, and finally returned to the four-way valve 27 by way of the return line 32. The refrigerant then passes along line 33 to the accumulator 34 and finally along the suction line 36 back to the compressor 24.

During the heating cycle, the four-way valve 27 passes the high pressure refrigerant along line 32 to the control box 11 where it is controlled in a manner to be described hereinafter, and then to one or more of the indoor coils 21, 22 or 23 where it is condensed to provide heat to the internal spaces. The resulting liquid refrigerant is then expanded and passed through the control box 11 for proper control. It then passes along line 31 to the outdoor coil 29 where it is evaporated, with the superheated vapor passing along line 29 to the four-way valve 27, then along line 33 to the accumulator 34, and finally along line 36 back to the compressor 24.

In either the cooling or heating mode as described hereinabove, it is necessary in conventional refrigeration cycle operation, that the refrigerant be expanded during its flow between the condenser coil and the evaporator coil. Traditionally this function has been accomplished with various expansion devices such as capillary tubes or orifice plates. A more recently used expansion device has been that of the so-called "accurator" which is shown and described in U.S. Pat. No. 3,877,248 issued to F. J. Honnold on Apr. 15, 1975 and assigned to the assignee of the present invention. A later variation on this device is the so-called "bypass accurator", which is shown and described in U.S. Pat. No. 3,992,898 issued to R. J. Duell, et al. on Nov. 23, 1976 and assigned to the assignee of the present invention. It is preferably such a bypass accurator which is used for the expansion devices in the present invention, both for the cooling and heating modes of operation.

For expansion during the cooling mode, these expansion devices 37, 38 and 39 of the type mentioned above are placed in the respective lines 41, 42 and 43, just upstream from the respective fan coils 21, 22 and 23 as shown. When the flow reverses during the heating cycle, the expansion devices 37, 38 and 39 act in the bypass mode to effectively remove their expansion component from the circuit. The expansion process during the heating cycle is then accomplished by the expansion devices 46, 47 and 48 which are placed in the respective lines 37, 38 and 39 just upstream from the control box 11 as shown.

It should be mentioned, that for the heating cycle of such a split system, the expansion device is conventionally placed similar to the expansion devices for the cooling cycle as shown, just upstream from the evaporator coil, i.e. in line 31 just upstream from the outdoor coil 29. However, in order to address the problem mentioned above, i.e. the reduction of flow of refrigerant from one or more of the fan coils 21, 22 or 23 when it is placed in a position of lower elevation than one or more of the other coils, the expansion process is accomplished in the individual lines 41, 42 and 43 prior to the coming together of the individual lines into a common line. In this way, because of the substantial pressure drop at the expansion devices 46, 47 and 48, there will be no significant reduction of flow from the lower elevation coil(s).

Recognizing the second problem as discussed hereinabove, i.e. that of required differential flow rates because of one or more of the fan coils 21, 22 and 23 being larger than the other(s), a further adaptation must be made. That is, while the placement of the expansion devices 46, 47 and 48 into the individual lines 41, 42 and 43 will solve the problems caused by elevational differences, it will tend to exacerbate the problems associated with differential coils sizes. To be more specific, because of the large pressure drop at the expansion devices 46, 47 and 48, it is at these points that the flow rates will be controlled, and the self-correcting feature, i.e., of the larger coil(s) having a greater head and therefore a greater flow, will be essentially lost. The solution found for solving this problem has therefore been to vary the size of the expansion devices 46, 47 and 48 in direct proportion to the size of the respective fan coils 21, 22 and 23. Thus, a larger fan coil will have a larger associated expansion device to thereby permit greater flow rates than its smaller counterparts, thereby preventing refrigerant backup in the larger unit(s). With the use of the accurator type expansion devices, this sizing step can be easily accomplished by slmply choosing the insert pistons having the proper orifice size to match the size of the associated fan coil. For example, fan coils having capacities of 6,000, 8,000 and 13,000 BTU/hr. will be matched with orifices having diameters of 0.036", 0.037" and 0.040", respectively.

To understand the variable operational features of the system, the components and functions of the control box 11 will now be described. It will be understood that, in order to accomplish the objectives of the multizone heat pump system, it is necessary to be able to shut down, or effectively remove from the system, any one or more of the fan coils while permitting the other fan coil(s) circuit to operate in a normal manner. This is true for both the heating and cooling cycles. Such a shutting down function is accomplished with the use of solenoid valves 51, 52 and 53 connected by respective lines 54, 55 and 56 to the fan coils 21, 22 and 23 on the one side and by solenoid valves 61, 62 and 63 connected by respective lines 66, 67 and 68 to the expansion devices 46, 47 and 48 on the other side. When, for example, the room in which the fan coil 23 is installed reaches the desired temperature as determined by its associated thermostat, while the temperatures in the room associated with fan coils 22 and 21 have not yet been satisfied, the control circuitry will automatically close the solenoid valves 53 and 63 to thereby effectively remove that portion of the circuit from the system. Subsequently, and in a similar manner, the solenoid valves 52 and 62 will eventually be automatically closed to shut down the fan coil 22 and the solenoid valves 51 and 61 will be automatically closed to shut down the fan coil 21. During that time period, the solenoid valves 53 and 63 may or may not be opened to bring the fan coil 23 back into operation. Thus, in a system with three fan coils, there may at any time be anywhere from 0 to 3 fan coils in operation with the particular combination being frequently varied.

While in principle the solenoid valves completely isolate their associated fan coil when the valves are in the off position, in practice there will be some leakage from the high pressure side and, over extended periods of time, that leakage can be substantial. For example, if, in the summertime, one room is not being used and its thermostat is therefore set at a high threshold temperature to prevent its fan coil from operating, while at the same time the other coils are periodically operational in the cooling mode there will be leakage of refrigerant from the high pressure side of the turned off solenoid valve, with the refrigerant flowing into the unused coil. There is, therefore, a removal of refrigerant from the active system to thereby lower the efficiency, but more importantly, there will be removed from the system a quantity of lubricant which settles from the stored refrigerant in the non-used coil, a condition which is undesirable because of its deprivation of required lubricant to the compressor 24.

During the cooling cycle, the problem of undesirable lubricant storage is alleviated by the use of suction valves 51, 52 and 53 with built in bypass features to allow for bleed-down of refrigerant and suspended lubricant back into the system. Such a valve is commercially available from the Sporlan Valve Co. as a Pilot Operated Solenoid Valve, Part Number CE9S240. In operation, when the leakage pressure in the fan coil reaches a predetermined threshold level, the bypass valve opens and allows refrigerant to re-enter the system via line 32.

During the heating cycle it is the solenoid valves 61, 62 and 63 on the liquid side which would provide the bypass feature to allow the trapped refrigerant to re-enter the system. However, because of the relatively smaller valves that are required in this location, and because of the liquid nature of the refrigerant at this point, the automatic bypass feature is not available. Accordingly, it is desirable to provide bleed-down capillary tubes 71 72 and 73 for interconnecting respective lines 66, 67 and 68 to the common line 31 by way of a check valve 74. The capillary tubes 71, 72 and 73 act in a manner similar to the bypass valves mentioned above to allow for the pumpdown into the system of refrigerant tending to accumulate in any unused coil(s). The check valve 74 acts to isolate the capillary tubes 71–73 during the cooling cycle.

One of the characteristics of a multizone system is that of a mismatch of outdoor and indoor coil capacities when only a portion of the fan coils are being used. For example, during periods when the fan coils 21 and 22 are shut down and the fan coil 23 is operating in the heating mode, the active condenser surface is reduced by two thirds from full capacity operation. The resulting effect is to cause an increase in the discharge pressure in line 26 of the compressor 24. If some provision is not made to reduce that pressure, the high pressure control switch will be automatically activated to shut down the system. Accordingly, a hot gas bypass valve 81 is provided to interconnect the lines 32 and 31 as shown in FIG. 2. The valve 81 is a pressure regulated, single direction valve which senses the pressure in the low pressure side at line 31 to bleed back the high pressure side liquid to the low pressure side when the threshold pressures are reached. This bypassing of a portion of the refrigerant around the single fan coil 23 allows the compressor discharge pressure to remain at a reasonable level during periods of single fan coil operation.

During the cooling cycle, when the fan coils 21 and 22 (for example) are shut down and the fan coil 23 is operating as an evaporator there is again a reduction of active fan coil capacity. The effect in this mode, however, is to cause the active operating coil 23 to operate in a highly superheated condition. This, in turn, will cause the compressor to lose suction in line 36. Such a condition can, of course, be somewhat alleviated by the use of a bypass valve similar to the valve 81 described hereinabove, to simply bleed a portion of the liquid from line 31 back into the low pressure line 32. An improvement over that approach is to use a thermocharger 82 as shown in FIG. 2. A thermocharger 82, which is of the type shown in U.S. Pat. No. 4,316,366 issued to John D. Manning on Feb. 23, 1982 and assigned to the assignee of the present invention, has a remote sensing bulb 83 to sense the temperature in the low pressure line 32 and to transmit that temperature along line 84 to operate the thermal expansion valve 86. The thermal expansion valve 86 is connected to the thermocharger 82 by way of a capillary tube 87. The thermocharger 82 has heat exchanger coils 88 and 89 contained therein, in heat exchange relationship. Interconnected between the heat exchanger 88 and the line 32 is a check valve 91 to prevent flow of refrigerant into the thermocharger 82 during the heating cycle.

In operation, during the cooling cycle the refrigerant will pass from line 31 through the heat exchange coil 89 before going to the fan coil(s) for evaporation. During periods when a single fan coil 23, for example, is in operation, the extent of the superheating condition will be sensed by the remote sensor 83 and when the pressure in line 32 reaches a predetermined level the thermal expansion valve 84 will be responsively opened. This will, in turn, cause a portion of the high pressure liquid refrigerant to be bled off from the line 92 to flow through the capillary tube 87, through the heat exchange coil 88, and be dumped back into the low pressure line 32 by way of the check valve 91. One resulting effect is to maintain the suction in line 26 going into the compressor 24 because of the liquid coolant that is being flashed off to the low pressure side 32. Another effect is to increase the efficiency of the operating fan coil 23 by subcooling the liquid refrigerant passing through the heat exchanger coil 89. In other words, the flashing off of the liquid refrigerant passing through the coil 82 tends to cool the refrigerant passing thereby in counterflow manner in the coil 89 such that there is an increase in the flow of refrigerant through the expansion device 39. An efficiency increase is therefore obtained, while at the same time, the suction to the compressor 24 is being maintained by the dumping of liquid refrigerant to the low pressure side.

It will be understood that the present invention has been described in terms of a preferred embodiment, but may take on any number of other forms while remaining within the scope and intent of the invention.

What is claimed is:

1. In a multizone air conditioning system of the type having multiple fan coils with fixed orifice refrigerant expansion devices, a portion of which fan coils are inactive at times, an improved bypass apparatus for diverting refrigerant from a high pressure line upstream of an active fan coil to a low pressure line downstream of the fan coil comprising:

means for sensing the temperature of the refrigerant in the low pressure line;

valve means responsive thereto for diverting a portion of liquid refrigerant from the high pressure line to the low pressure line when said sensed temperature reaches a predetermined level;

a bypass refrigerant expansion device disposed between said valve means and the low pressure line to cause said diverted portion to flash to a vapor; and a heat exchanger for placing said vapor from said bypass refrigerant expansion device in heat exchange relationship with the high pressure line to thereby cool the refrigerant flowing directly to the fixed orifice expansion devices at a pressure substantially equal to that in the high pressure line.

2. An improvement in a multizone air conditioning system of the type having a bypass line for passing a portion of liquid refrigerant from a high pressure line to a low pressure line when only a portion of a plurality of fan coils having fixed orifice refrigerant expansion devices are in active use for cooling while the remaining fan coils are inactive within the system comprising:

a subcooler with two heat exchanged coils mounted in heat exchange relationship therein, the first being disposed in the bypass line and adapted to pick up heat and the second being disposed in the high pressure line and adapted to give up heat to the first prior to the refrigerant flowing directly to the fixed orifice expansion device at a pressure substantially equal to that in the high pressure line.

3. The improvement as set forth in claim 2 and including a valve disposed in the bypass line for selectively bypassing a portion of the liquid refrigerant.

4. The improvement as set forth in claim 3 and including temperature sensing means associated with said valve, said temperature sensing means being connected to and responsive to the temperature of the refrigerant in the low pressure line.

5. In a multizone air conditioning system of the type having a bypass line for diverting a portion of liquid refrigerant from a high pressure line to a low pressure line when only a portion of a plurality of indoor coils having fixed orifice refrigerant expansion devices are in active use, a flash subcooler comprising:

a first heat exchange coil associated with the high pressure line; and a second heat exchange coil disposed in heat exchange relationship with said first heat exchanger coil, said second heat exchange coil being so connected as to have the diverted portion of refrigerant flow therethrough to thereby subcool the liquid refrigerant flowing through the first heat exchange coil directly to the fixed orifice expansion devices of the active portion of the indoor coils at a pressure substantially equal to that in the high pressure line.

6. A flash subcooler as set forth in claim 5 and including a valve for controlling the flow of refrigerant in said second heat exchange coil.

7. A flash subcooler as set forth in claim 6 and including a temperature sensitive means associated with said valve, said temperature sensitive means being connected to and responsive to the temperature of the refrigerant in the low pressure line.

* * * * *